United States Patent [19]

Cresswell

[11] Patent Number: 4,706,701

[45] Date of Patent: Nov. 17, 1987

[54] ODOR TRAP ASSEMBLY

[76] Inventor: Robert L. Cresswell, R.D. 1, Box 1081, Hadley, Pa. 16130

[21] Appl. No.: 891,039

[22] Filed: Jul. 31, 1986

[51] Int. Cl.[4] ..... E03C 1/00; F16K 13/00; F16K 13/10; F16L 43/00

[52] U.S. Cl. ..... 137/247.41; 4/207; 4/321; 4/323; 4/661; 4/DIG. 13; 137/247; 137/247.11; D23/268; D23/200

[58] Field of Search ..... 4/207, 661, 206, 321, 4/323, 197, 307; 137/247, 247.11, 247.31, 247.41, 247.49; 185/10, 11; D23/1, 46, 49; 138/118, 121

[56] References Cited

U.S. PATENT DOCUMENTS

| | | | |
|---|---|---|---|
| D. 231,930 | 6/1974 | Danks | D23/46 |
| 270,211 | 1/1883 | Farthing | 4/DIG. 13 |
| 1,213,207 | 1/1917 | Keller | 4/211 |
| 1,762,419 | 6/1930 | Pettis | 4/219 |
| 2,817,092 | 12/1957 | Hahn | 4/DIG. 13 |
| 3,302,216 | 2/1967 | Fulton et al. | 4/DIG. 16 |
| 3,313,314 | 4/1967 | Burke et al. | 4/206 X |
| 3,766,575 | 10/1973 | Grengs | 4/210 |
| 3,860,978 | 1/1975 | Wirth | 4/207. |
| 3,894,301 | 7/1975 | Bunch | 4/211 |
| 3,908,208 | 9/1975 | McIlroy | 138/118 X |
| 4,151,864 | 5/1979 | Thurman | 138/121 X |
| 4,180,102 | 12/1979 | Larkin | 138/121 X |
| 4,228,978 | 10/1980 | Rand | 138/121 X |
| 4,643,229 | 2/1987 | Hickin | 4/323 X |

FOREIGN PATENT DOCUMENTS

| | | | |
|---|---|---|---|
| 1063711 | 3/1967 | United Kingdom | 4/DIG. 13 |

*Primary Examiner*—Henry K. Artis
*Attorney, Agent, or Firm*—Henderson & Sturm

[57] ABSTRACT

An odor trap assembly (10) comprising a drain hose unit (12) connected between a holding tank inlet (12) connected between a holding tank inlet (20) and a remote collection receptacle (50); and, a framework unit (11) having at least one elevated support surface (14) formed intermediate its ends; wherein the height of the said at lest one elevated support surface (14) is sufficient to create a liquid barrier (100) within the drain hose unit (12) when a portion of said drain hose unit (12) is draped over said at least one elevated (12) support surface.

6 Claims, 5 Drawing Figures

ODOR TRAP ASSEMBLY

TECHNICAL FIELD

The present invention relates generally to odor trap assemblies for sewage systems, and more specifically to an odor trap assembly particularly developed for use with motor homes, house trailers, and recreational vehicles.

BACKGROUND OF THE INVENTION

While the prior art is replete with odor trap assemblies used to prevent the transmittal of objectionable odors back through a waste water or sewage fixture, as can be seen by reference to U.S. Pat. Nos. 1,762,414; 3,766,575; 3,894,301 and 1,213,207; all of these acknowledged prior art constructions involve permanent installations and only one of them deals specifically with the particular environment for which the present invention was developed.

Admittedly these prior art constructions are more than adequate for their intended purpose and function; however, as mentioned above, permanent installations are neither particularly suitable nor adaptable for use in conjunction with house trailers, motor homes and recreational vehicles, wherein the waste water and sewage outlets are often temporarily connected to underground sewage collections sumps.

In the environment just mentioned, the standard procedure involves the connection of a flexible drain hose to the holding tank of a house trailer or the like, with the free end of the drain hose extending downwardly into a septic or waste collection receptacle. Waste water and/or sewage will then flow by gravity into the underground collection receptacle.

Unfortunately the same principles that govern the flow of liquid wastes into the collection receptacle, also allow noxious gases to be transmitted from the collection receptacle back through the drain pipe and up into the holding tank of the house trailer or the like.

Not only is this situation unpleasant and objectionable to the occupants of the structure involved; but, this situation also represents a very clear and present danger to the occupants health and well being, not to mention their personal comfort and peace of mind.

In light of the foregoing situation, it was recognized that there was a pressing need to develop a solution to the aforementioned problem; and, the present invention accomplishes that objective in a very simple yet unique manner, as will be explained shortly.

SUMMARY OF THE INVENTION

To begin with, several problems had to be addressed prior to arriving at the solution that forms the basis of the present invention.

First of all it was clearly recognized that permanent and/or rigid odor trap assemblies would be either impractical and/or non-functional in the particular environment involved.

It was further recognized that while unimpeded gravity flow of the liquid wastes was necessary in one mode of operation; the other mode of operation required that a liquid barrier be created between the holding tank and the underground receptacle, to prevent odors emanating from the receptacle from reaching the holding tank.

The solution to these problems was ultimately arrived at by the provision of a framework unit to be used in conjunction with the drain hose unit whereby in one mode of operation the drain hose unit would extend through the surrounding framework unit; and, in the other mode of operation at least one portion of the drain hose unit would be draped over at least one portion of the framework unit, whereby the drain hose unit would be elevated so as to create a liquid barrier within the interior of the drain hose unit.

As will be described in greater detail later on in the specification, the framework unit of this invention cooperates with the drain hose unit, to accommodate the drain hose unit in a variety of elevated configurations relative to the framework.

In one mode of deployment the drain hose unit is draped over the center of the framework unit. In another mode of deployment the drain hose may be optionally draped over either end of the framework unit; and, in still another mode of deployment, the drain hose unit is draped over both ends of the framework unit.

Any of the aforementioned modes of elevated deployment of the drain hose unit relative to the framework unit will be effective to create a liquid barrier within the drain hose unit; and, the numerous choices of deployment allows a wide degree of flexibility to the end user that further enhances the utilitarian aspects of this invention.

BRIEF DESCRIPTION OF THE DRAWINGS

These and other objects, advantages, and novel features of the invention will become apparent from the detailed description of the best mode for carrying out the preferred embodiment of the invention; particularly when considered in conjunction with the accompanying drawings, wherein.

BEST MODE FOR CARRYING OUT THE INVENTION

Figure 1:
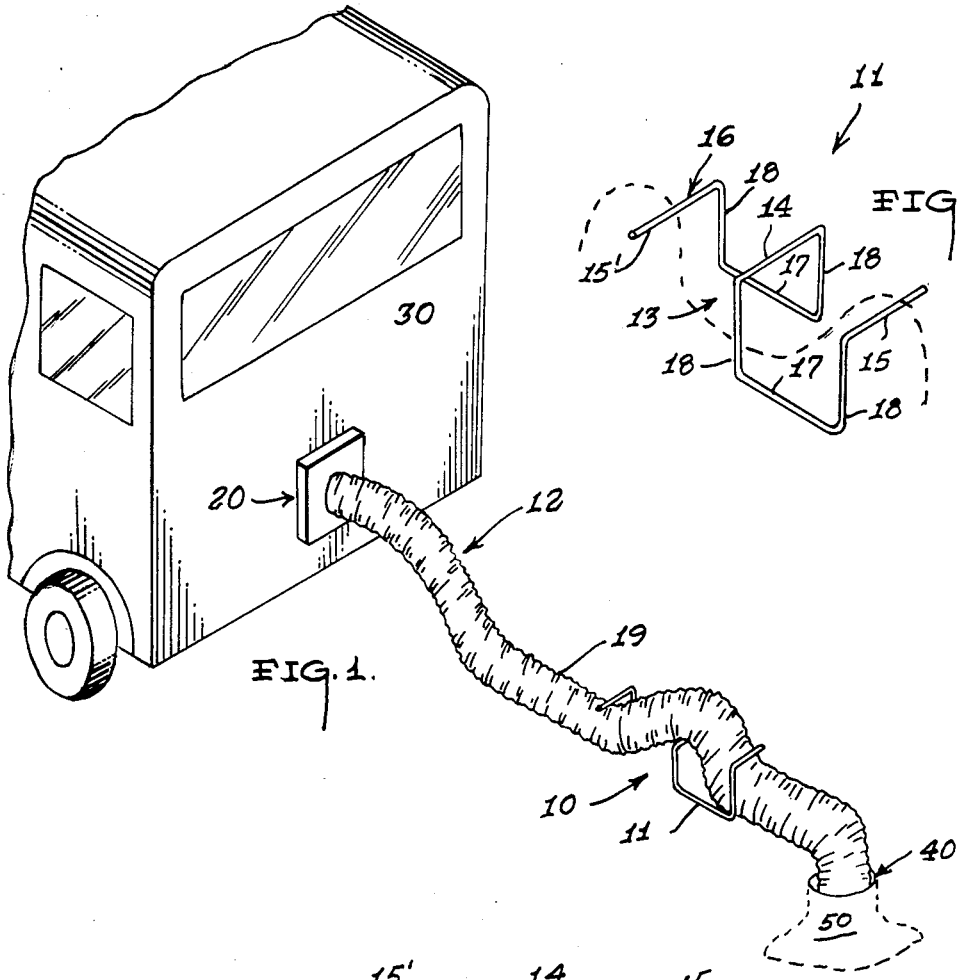
FIG. 1 is a perspective view of the odor trap assembly in its intended environment.

As can best be seen by reference to FIG. 1, the odor trap assembly of the present invention is designated generally by the reference numeral (10); and, is intended to be deployed intermediate the holding tank outlet (20) of an inhabitable structure (30) such as a house trailer, motor home, recreational vehicle, or the like, and the outlet (40) of a remote underground collection receptacle (50) (shown in phantom) provided to collect the effluent from the holding tank (not shown).

As depicted in the drawings, the odor trap assembly (10) comprises in general a framework unit (11) and a drain hose unit (12). These units will now be described in seriatim fashion.

Figure 2:
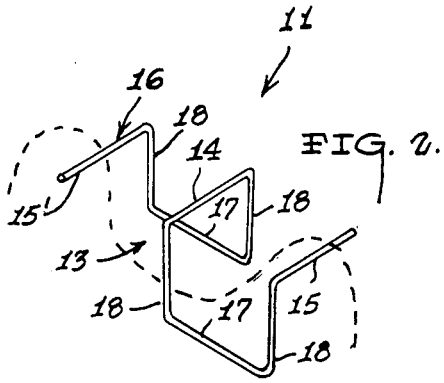
FIG. 2 is an isolated perspective view of the framework unit.

As shown in FIG. 2, the framework unit (11) comprises in general an open framework member (13) having r. at least one elevated support surface (14) formed intermediate the ends of the open framework member (13) wherein the height of the at least one elevated support surface (14) is greater than the outside diameter of the drain hose unit (12) to allow the unobstructed passage of the drain hose unit (12) beneath the at least one elevated support surface.

In the preferred embodiment depicted in FIG. 2, the open framework member (13) is provided with a plurality of spaced apart elevated support surfaces which include an intermediate elevated support surface (14) and outboard elevated support surfaces (15)(15') formed on the ends of the framework member (13).

Still referring to FIG. 2, it can be appreciated that the open framework member (13) of the preferred embodiment comprises an elongated, narrow, generally cylindrical element (16), such as a hollow tube, or solid rod, that has been deformed into the desired configuration.

As shown in FIG. 2, the outboard elevated support surfaces (15)(15') are formed by deforming the ends of the elongated cylindrical element (16) into a generally inverted L-shaped configuration. The intermediate elevated support surface (14) is formed by deforming the intermediate portion of the elongated cylindrical element (16) into an inverted U-shaped configuration; and, the outboard elevated support surfaces (15)(15') are connected to the intermediate elevated support surface (14) by a pair of off-set horizontally disposed ground engaging leg elements (17).

Described in other words, the framework unit (11) comprises at least four vertical support legs (18) operatively associated with at least three elevated (14)(15)(15'1) support surfaces, which are connected together by a pair of horizontally disposed ground engaging leg elements (17) to form the framework unit (11).

As best shown in FIG. 1, the drain hose unit (12) comprises an elongated length of a flexible drain pipe element (19) that is connected on one end to the holding tank outlet (20), and has its other end disposed in the inlet (40) of an underground collection receptacle (50).

Figure 3:
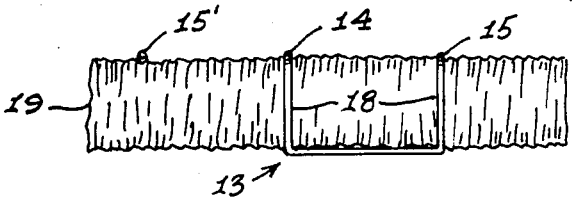
FIG. 3 is a side elevation showing the framework unit and drain hose unit in the gravity flow mode.

As can best be appreciated by reference to FIG. 3, the vertical support legs (18) of the open framework member (13) are dimensioned to permit the passage of the drain pipe element (19) beneath the elevated support surfaces (14)(15)(15'). In this mode of operation of the assembly (10) there would be an unimpeded gravity flow of effluent from the holding tank outlet into the underground collection receptacle (50). It should also be appreciated at this juncture that the external periphery of the flexible conduit is held captive by the four vertical legs (18) of the open framework member (13) which are disposed in off-set pairs on opposite sides of the drain pipe element.

Figure 4:
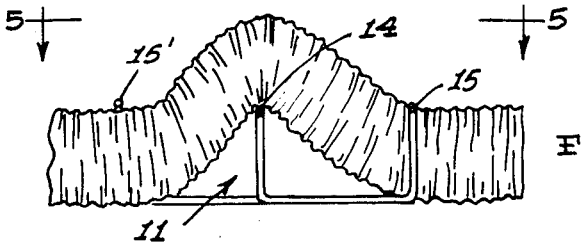
FIG. 4 is a side elevation showing the framework unit and drain hose unit in one of the liquid barrier modes; and, FIG. 5 is a cross-sectional view taken thru line 5—5 of FIG. 4.
Figure 5:
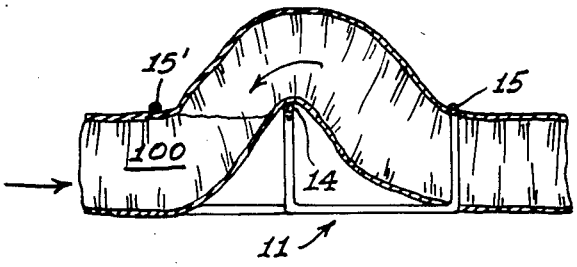

FIGS. 4 and 5 depict one possible mode of deployment of the assembly (10) to create liquid barrier (100) within the interior of the hose element (19) in keeping with the teachings of this invention. In this mode of deployment the hose element (19) is draped over the intermediate elevated support surface (14); wherein fluid discharge from the holding tank outlet (20) will accumulate on the upstream side of the portion of pipe element (19) supported by the intermediate elevated support surface (14), to create a liquid barrier (100) to prevent the migration of malodorous gases upstream of the liquid barrier (100).

Referring once more to FIG. 2, the dashed line indicates the tortuous path assumed by the hose element in another proposed mode of deployment; wherein the hose element (19) is draped over both the outboard elevated support surfaces (15)(15') and under the intermediate elevated support surface (14). In this particular mode of deployment a dual liquid barrier can be created on the upstream portions of the hose element (19) supported by the respective outboard elevated support surfaces (15)(15').

It should also be appreciated at this juncture that the last two proposed modes of deployment involve draping the flexible hose element (19) over either of the outboard elevated support surfaces (15) or (15') and under the intermediate elevated support surface (14), which will only create a single liquid barrier (100) regardless of the outboard elevated support surface chosen.

Having thereby described the subject matter of this invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A portable odor trap assembly for connection between a holding tank outlet and the inlet of a remote collection receptacle; wherein the apparatus comprises:

a drain hose unit comprising an elongated flexible drain hose element adapted to be connected on one end to the said holding tank outlet and having its other end adapted to be in fluid communication with the inlet of said remote collection receptacle and a ground supported frame-work unit, said hose unit supported on said framework unit, said framework unit comprising an open framework member having at least one elevated support surface formed intermediate its ends, wherein the height of said at least one elevated support surface is sufficient with respect to said hose unit to form an accumulated liquid barrier within said flexible drain hose element in the direction of flow, when a portion of said drain hose element is draped over said at least one elevated support surface element, and effluent from said holding tank is introduced into the interior of said flexible drain hose element.

2. The assembly as in claim 1; wherein, said at least one elevated support surface has a height that is greater than the outside diameter of the drain hose unit.

3. The assembly as in claim 1; wherein, the framework unit further comprises:

a plurality of spaced apart elevated support surfaces formed on said open framework member.

4. The assembly as in claim 3; wherein, said plurality of spaced apart elevated support surfaces formed on said open framework member includes:

said at least one elevated support surface formed intermediate the ends of said open framework member; and, outboard elevated support surfaces formed on the ends of said open framework member.

5. The assembly as in claim 4; wherein, each of said plurality of elevated support surfaces has a height sufficient to form an accumulated liquid barrier within said drain hose element, when said drain hose element is draped over a selected one of said plurality of elevated support surfaces.

6. The assembly as in claim 4; wherein, the said outboard elevated surfaces are capable of forming a double liquid barrier within said drain hose element, when said drain hose element is draped over both of said outboard elevated support surfaces, while being simultaneously passed beneath said at least one elevated support surface formed intermediate the ends of said open framework member.

* * * * *